US009922813B2

(12) United States Patent
Cooks et al.

(10) Patent No.: US 9,922,813 B2
(45) Date of Patent: Mar. 20, 2018

(54) SYSTEMS AND METHODS FOR EJECTION OF IONS FROM AN ION TRAP

(71) Applicant: Purdue Research Foundation, West Lafayette, IN (US)

(72) Inventors: Robert Graham Cooks, West Lafayette, IN (US); Dalton Snyder, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 15/421,934

(22) Filed: Feb. 1, 2017

(65) Prior Publication Data

US 2017/0221695 A1 Aug. 3, 2017

Related U.S. Application Data

(60) Provisional application No. 62/319,330, filed on Apr. 7, 2016, provisional application No. 62/289,426, filed on Feb. 1, 2016.

(51) Int. Cl.
*H01J 49/42* (2006.01)
*H01J 49/00* (2006.01)

(52) U.S. Cl.
CPC ..... *H01J 49/4285* (2013.01); *H01J 49/0013* (2013.01); *H01J 49/4225* (2013.01)

(58) Field of Classification Search
CPC ..... H01J 49/4285; H01J 49/4225; H01J 49/0013; H01J 49/4265; H01J 49/4275; H01J 49/426; H01J 49/424
See application file for complete search history.

(56) References Cited

U.S. PATENT DOCUMENTS 5,714,755 A * 2/1998 Wells ..... H01J 49/424 250/281
2008/0073508 A1* 3/2008 Hashimoto ..... H01J 49/0045 250/288
2015/0303047 A1* 10/2015 Jiang ..... H01J 49/4285 250/283

* cited by examiner

*Primary Examiner* — Jason McCormack
*Assistant Examiner* — Sean Luck
(74) *Attorney, Agent, or Firm* — Brown Rudnick LLP; Adam M. Schoen

(57) ABSTRACT

The invention generally relates to systems and methods for ejection of ions from an ion trap. In certain embodiments, systems and methods of the invention sum two different frequency signals into a single summed signal that is applied to an ion trap. In other embodiments, an amplitude of a single frequency signal is modulated as the single frequency signal is being applied to the ion trap. In other embodiments, a first alternating current (AC) signal is applied to an ion trap that varies as a function of time, while a constant radio frequency (RF) signal is applied to the ion trap.

6 Claims, 12 Drawing Sheets

SYSTEMS AND METHODS FOR EJECTION OF IONS FROM AN ION TRAP

RELATED APPLICATIONS

The present applications claims the benefit of and priority to U.S. provisional application Ser. No. 62/319,330, filed Apr. 7, 2016, and U.S. provisional application Ser. No. 62/289,426, filed Feb. 1, 2016, the content of each of which is incorporated by reference herein in its entirety.

GOVERNMENT INTEREST

This invention was made with government support under NNX12AB16G and NNX16AJ25G awarded by the National Aeronautics and Space Administration (NASA). The government has certain rights in the invention.

FIELD OF THE INVENTION

The invention generally relates to systems and methods for ejection of ions from an ion trap.

BACKGROUND

Quadrupole ion traps are widely used to record mass spectra by a variety of methods. The most widely used methods employ the mass selective instability scan in which ions are destabilized and ejected from the trap in order of mass/charge. Normally the amplitude of the trapping radiofrequency waveform is ramped to record the mass spectrum but the frequency can also be ramped. For ion motion in the z-direction and external ion detection, the Mathieu equation, which connects points in dimensionless Mathieu parameter $a_z$,$-q_z$ space with device size ($z_0$), operating conditions (amplitude V, angular frequency of rf Ω) and ion properties (m/z), the relationship in Eq. 1 applies. At the z-axis stability boundary, $q_z$=0.908, ions become unstable and are ejected, so that an m/z scan is accessible through ramping the rf amplitude (V) or altering the rf angular frequency (Ω).

$$m/z=4V_{rf}/[\Omega^2 z_0^2 q_z] \quad \text{Eq. 1}$$

A variant on the RF amplitude method of scanning ions from a trap termed "resonance ejection" uses a small supplementary ac signal to impose a second working point or "hole" on the q axis, i.e. instability can be caused at any arbitrary m/z (and $q_z$) value. Trapped ions can then be scanned through this operating point and ejected in order of increasing m/z as the rf amplitude $V_{rf}$ is increased. This method of resonance ejection is well-established. It shows significantly increased mass resolution compared to simply scanning across the instability boundary ($q_z$=0.908) and is also useful as a method of increasing the mass/charge range of the ion trap (the increase is the ratio of 0.908 to the value of q at the new instability point).

Eq. 1 also forms the basis for so-called digital ion traps in which the frequency of the drive rf is scanned. However there is a different type of frequency scan which also gives mass spectra, the secular frequency scan. Ion stability in characteristic dimensions r and z is usually expressed in terms of dimensionless Mathieu parameters a and q. The stability condition can also be expressed in terms of Mathieu β parameters. The relationship between the ion secular frequency and the Mathieu β parameter is:

$$\omega_z=\beta_z\Omega/2 \quad \text{Eq 2}$$

A mass spectrum can be recorded by ramping the frequency of the supplementary ac so that resonance is possible with ions of different secular frequencies. This experiment, known as a secular frequency scan, has the practical advantage of not requiring a scan of the main rf amplitude or frequency, and hence using simpler instrumentation. This allows a relatively low amplitude dipolar frequency to be swept to produce a resonance with ions having different m/z values (and hence different secular frequencies). This experiment can be thought of as scanning a secular frequency "hole" through all possible $q_z$ values by ramping the frequency of the supplementary ac.

SUMMARY

The invention provides systems and methods of increasing mass resolution by using double resonance ejection at any arbitrary fixed or varying frequency. Significant improvement in mass resolution is observed. Double resonance ejection with either static or dynamic frequencies is shown to more than triple the resolution of the ion trap. The systems and methods of the invention are shown to be applicable to any arbitrary static or dynamic resonance frequency, improving versatility and increasing resolution regardless of frequency and method chosen.

Aspects of the invention involve use of the secular frequency of ions to perform resonance excitation coupled with the fact that ions of particular m/z values have multiple resonance frequencies at which they can be excited and ejected from a quadrupole ion trap. These resonances may include the fundamental secular frequency, which is most often used as such or for dipolar resonance ejection, as well as higher order quadrupolar resonances, other higher order (e.g. hexapolar and octopolar) resonances, and sideband frequencies of the rf driving frequency.

In certain aspects, the invention provides a system that includes a mass spectrometer having an ion trap, and a central processing unit (CPU), and storage coupled to the CPU for storing instructions. The instructions, when executed by the CPU, cause the system to generate a first frequency signal, generate a second frequency signal, sum the first and second frequency signals to produce a single summed frequency signal, and apply the single summed frequency signal to the ion trap. Corresponding methods of the invention involve generating a first frequency signal, generating a second frequency signal, summing the first and second frequency signals to produce a single summed frequency signal, and applying the single summed frequency signal to the ion trap.

In certain embodiments, the first frequency signal is an arbitrary frequency ω and the second frequency signal is a lower trapping sideband $\Omega_{rf}-\omega$. In other embodiments, the first and second frequency signals are selected from the group consisting of 2ω, $\Omega_{rf}-2\omega$; and 3ω, $\Omega_{rf}-3\omega$. In certain embodiments, the first frequency signal ω corresponds to a higher order resonance associated with the structure of the ion trap, and the second frequency signal corresponds to $\Omega_{rf}+/-\omega$. In other embodiments, the first frequency signal is an alternating current (AC) signal, and the second frequency signal is radio frequency (RF) signal that varies as a function of time. In certain embodiments, the systems and methods involve applying a third frequency to the ion trap.

In other aspects, the invention provides systems that include a mass spectrometer having an ion trap, and a central processing unit (CPU), and storage coupled to the CPU for storing instructions. The instructions, when executed by the CPU, cause the system to generate a single frequency signal, and modulate an amplitude of the single frequency signal as the single frequency signal is being applied to the ion trap.

Corresponding methods of the invention involve generating a single frequency signal, and modulating an amplitude of the single frequency signal as the single frequency signal is being applied to the ion trap. In certain embodiments, the single frequency signal is a radio frequency (RF) signal. In certain embodiments, the systems and methods involve applying a second frequency to the ion trap.

In other aspects, the invention provides systems that include a mass spectrometer having an ion trap, and a central processing unit (CPU), and storage coupled to the CPU for storing instructions. The instructions, when executed by the CPU, cause the system to apply a constant radio frequency (RF) signal to the ion trap, and apply a first alternating current (AC) signal to the ion trap that varies as a function of time. Corresponding methods of the invention involve applying a constant radio frequency (RF) signal to the ion trap, and applying a first alternating current (AC) signal to the ion trap that varies as a function of time.

In certain embodiments, the systems and methods of the invention further involve varying a frequency of the first AC signal as a function of time. In certain embodiments, the systems and methods of the invention further involve varying an amplitude of the first AC signal as a function of time. In certain embodiments, the first AC signal is in resonance with a secular frequency of ions trapped within the ion trap. In certain embodiments, systems and methods of the invention additionally involve applying a second alternating current (AC) signal to the ion trap that varies as a function of time, the second AC signal being applied orthogonally to the first AC signal.

Numerous different ion trap configurations may be used with systems and methods of the invention. Exemplary ion traps include quadrupole ion traps, a hyperbolic ion trap, a cylindrical ion trap, a linear ion trap, a rectilinear ion trap. The mass spectrometer may be a bench-top mass spectrometer or a miniature mass spectrometer. The systems of the invention may additionally include an ionization source. The methods of the invention may additionally including the step of ionizing a sample.

BRIEF DESCRIPTION OF THE DRAWINGS

FIG. 4A shows mass precision of single and double resonance ejection on an LTQ XL without phase-locking. FIG. 4B shows an average of 3 scans for a single resonance ejection experiment (345 kHz, 3 Vpp) on the Mini 12 mass spectrometer. FIG. 4C shows an average of 3 scans for a double resonance ejection experiment (345 kHz, 3 Vpp, plus 648.6 kHz, 4 Vpp) with the ac phase-locked to the rf. Experimental parameters for FIG. 4A: Single resonance ejection was performed by ramping the rf amplitude from m/z 50 to m/z 1000 while an externally generated resonance signal of 4 Vpp and 500 kHz was applied to the x electrodes. Double resonance was performed similarly, but the resonance signal had frequency components 500 kHz and 693 kHz (4 Vpp each). Mass spectrometer was an LTQ XL linear ion trap. Calculations are based on N=15 mass measurements for each bar. Analytes were quaternary amines of the given masses.

FIG. 5A shows single resonance ejection during a normal LTQ scan from m/z 50 to m/z 1000 with a single resonance frequency of 450 kHz at 6 Vpp. FIG. 5B shows a resonance scan by modulating the amplitude of the 450 kHz waveform at 884 kHz with a 100% modulation depth. Analytes were quaternary ammonium ions m/z 284, 360, and 382.

FIG. 6A shows the forward frequency single resonance secular frequency scan of a 600 mVpp waveform scanned linearly from 100 to 500 kHz over 1 s during an Ultrazoom scan from 200 to 227. FIG. 6B shows the equivalent reverse frequency scan. FIG. 6C shows the forward frequency double resonance secular frequency scan with an added dipolar resonance swept from 1074 to 675 kHz with an amplitude of 2 Vpp. FIG. 6D shows the reverse double resonance scan. Analytes were quaternary ammonium ions m/z 284, 360, and 382.

DETAILED DESCRIPTION

Figure 1:
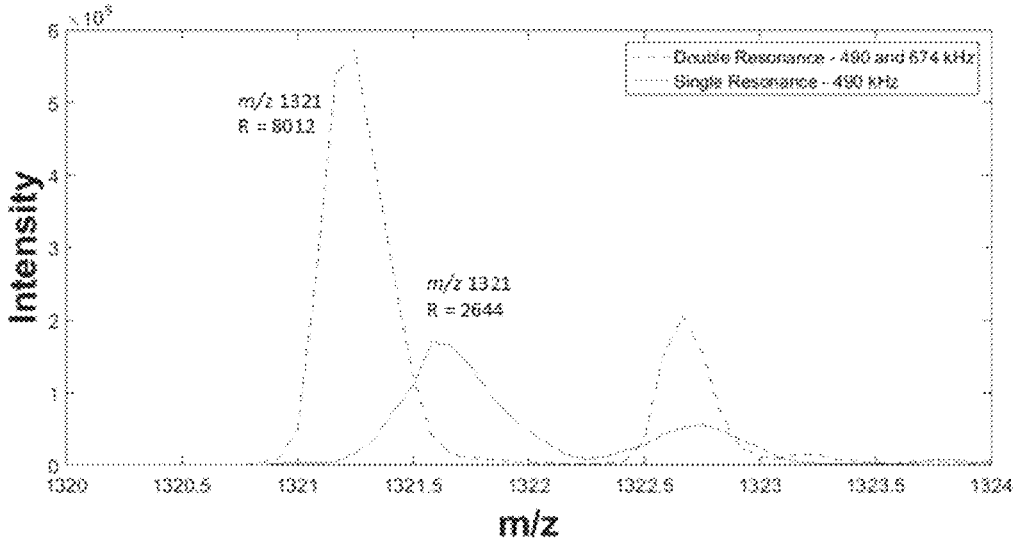
FIG. 1 shows comparison of resolution obtained by single and double resonance ejection using sideband frequencies. The solid orange trace shows m/z 1321 from an Ultramark 1621 calibration solution obtained by single resonance ejection at 490 kHz with a 4 Vpp ac amplitude while the rf amplitude was ramped from lmco 50 to lmco 1000. The dotted blue trace shows an equivalent experiment using double resonance at 490 kHz and the equivalent sideband at 674 kHz (summed sinusoids, 4 Vpp amplitude each, zero degree phase shift).

Multiple frequency resonance experiments were performed in three distinct ways. In the first type of experiment, a double frequency signal was simply substituted for the single frequency of the usual resonance ejection experiment (e.g., application of a supplementary ac while ramping the rf amplitude) to provide a mass spectrum (or, after ion isolation and collisional activation, a two stage MS/MS spectrum). Double resonance ejection was performed by combining two frequency components corresponding to the fundamental secular frequency (ω) and the first lower sideband of the rf frequency (Ω−ω). The resulting waveform can directly replace the resonance ejection waveform in a benchtop linear ion trap mass spectrometer operated under otherwise normal resonance ejection conditions. In a variant, the second type of experiment used amplitude modulation with a single frequency resonance ejection experiment. This method also improves mass resolution. Secular frequency scanning, which provides an alternative method of recording mass spectra was shown to give improved performance by using both ω and (Ω−ω) and ramping both frequencies linearly at constant rf amplitude to effect the third type of experiment, viz. a double resonance secular frequency scan. It is emphasized that the first two experiments are variants on resonance ejection, where a scan of $V_{rf}$ gives the mass spectrum, while the third experiment is a type of secular frequency scan employing multiple frequency components.

Higher order resonances include higher order quadrupolar resonances, $\omega_{u,0}$, which occur where n=0 in the equation $$\omega_{u,n}=|n+\beta|\Omega/K \quad -\infty<n<\infty,\ K=1,2,\ldots \qquad \text{Eq 3}$$

with K being the order of the resonance and n being an integer. When |n|>0 one obtains harmonics at, for example, $2\omega_{u,0}$ and $3\omega_{u,0}$. All these resonances are known to be substantially weaker than the fundamental resonance and are thus not commonly sought or observed, as described in Franzen's series of papers on the nonlinear ion trap (Wang et al., Int. J. Mass Spectrom. Ion Proc. 1993, 124, 125; Franzen, Int. J. Mass Spectrom. Ion Processes 1993, 125, 165; Franzen, Int. J. Mass Spectrom. Ion Proc. 1994, 130, 15; and Wang et al., Int. J. Mass Spectrom. Ion Proc. 1992, 112, 167).

Franzen also described hexapolar, octopolar, and other higher order resonances. The general resonance condition is $$(\beta_r/2)n_r+(\beta_z/2)n_z=1 \qquad \text{Eq 4}$$

where r and z are the radial and axial dimensions, respectively, $n_r$ and $n_z$ are nonnegative integers, $n_r$ is even or zero, and $n_z$ is either even or odd. The general resonance condition for the first stability region can equivalently be described in the frequency domain by $$n_r\omega_r+n_z\omega_z=\nu\Omega \qquad \text{Eq 5}$$

where $n_r$, $n_z$, and v are positive integers restricted by the conditions that, for traps of axial symmetry, $n_r$ is even and $n_z$ is even for even multipoles and any integer for odd multipoles. For example, β=⅔ ($n_r$=0, $n_z$=3) corresponds to hexapole, decapole, and tetradecapole resonances. Hexapole resonances also occur at β=⅓, ½, and ⅖, with the strength of the resonance decreasing rapidly with decreasing β. An octopole resonance appears at β=½, but this resonance is self-quenching because the frequency of ion motion shifts substantially with the distance from the trap center. Positive frequency shifts are observed for a positive octopole contribution since the field strength near the electrodes increases faster than a pure quadrupole field. In contrast, negative shifts are observed for a negative octopole, whereas odd-order multipoles always decrease ion oscillatory frequencies due to their asymmetry, which causes ions to occupy regions of lower field strength.

Franzen showed that ion ejection at a nonlinear resonance point, specifically the hexapole resonance at β=⅔, greatly increases mass resolution, and this capability was incorporated into the commercial Bruker ion trap instrument. The scan was termed a "double resonance ejection" due to the co-occurrence of the dipolar excitation and the hexapolar (or octopolar) nonlinear resonance. The effect of the hexapolar or octopolar resonance is to make the rate of ion ejection faster than the normal linear amplitude growth with time, thus resulting in better resolution. A similar triple resonance scan mode also exists. The method is similar to double resonance ejection, where double resonance is achieved by parametric excitation at the hexapole resonance, and the triple resonance is realized by simultaneously applying a dipolar waveform with lower sideband (Ω−ω) corresponding to the hexapolar resonance, again at β=⅔. Other sidebands, which generally occur at nΩ±mω, n and m being positive integers, may also be interrogated, but their magnitudes diminish rapidly with increasing n and m.

The double resonance method of this invention can be applied using either a ramped or fixed rf amplitude at any arbitrary static or dynamic frequency in ion traps with various higher-order field contributions and should be much more versatile than methods of the prior art.

Here, a more general method of multiple resonance ejection is described and demonstrated in the case of double resonance. Double resonance can be achieved at any arbitrary fixed or varied frequency by combining two frequency components, the fundamental secular frequency and the corresponding lower sideband frequency, into a single waveform that is applied to an ion trap in a dipolar fashion. The method additionally retains the increase in resolution that has been previously demonstrated. Double resonance ejection at arbitrary frequencies can be accomplished by synthesizing a single dipolar waveform with two frequency components. The first frequency is set to any arbitrary frequency. This is in contrast to previous reports of double (Wang et al., J. Mass Spectrom. 2013, 48, 937) and triple (Moxom et al., Rapid Commun Mass Spectrom 2002, 16, 755) resonance which were performed only at nonlinear resonance points. While these nonlinear resonance points increase resolution, their presence is not necessary for double resonance. Double resonance at arbitrary frequencies is differentiated from previous work because the frequencies that are interrogated are characteristic of the ions themselves and not characteristic of particular field components. That is, the resonance conditions are inspired by the induced frequencies of ion motion rather than by higher order field components.

In one embodiment, ions were generated by nanoelectrospray ionization (nESI) at ~2 kV. Typical spray tip diameters were ~5 micrometers. Didodecyldimethylammonium bromide was purchased from Sigma Aldrich (St. Louis, Mo., USA), hexadecyltrimethylammonium bromide was purchased from Tokyo Chemical Industry Co. (Tokyo, Japan), and benzylhexadecyldimethylammonium chloride was purchased from JT Baker Chemical Co (Phillipsburg, N.J., USA). Reagents were dissolved in HPLC grade methanol and then diluted in 50:50 MeOH:$H_2O$ with 0.1% formic acid to final concentrations of ~5 ppm. Ultramark 1621 calibration solution was obtained from Thermo Fisher (Rockford, Ill., USA). Instrumentation: All experiments were performed using a Thermo LTQ XL linear ion trap mass spectrometer interfaced to an Orbitrap (San Jose, Calif., USA). The rf frequency was tuned to 1175 kHz. For static resonance ejection, the built-in normal scan function was used, but, unless otherwise specified, the resonance ejection signal was replaced with an ac waveform of specified frequency and amplitude. This waveform was supplied by a Keysight 33612A arbitrary waveform generator (Newark, S.C., USA).

For double resonance ejection, two channels were set to different frequencies and summed into a single channel. One frequency was less than half the driving rf frequency and the other was set to the corresponding lower sideband $\Omega-\omega$, where $\omega$ represents the low frequency. General frequencies were 10-587.5 kHz and 587.5-1175 kHz, respectively. Double resonance secular frequency scanning was similarly performed during an Ultrazoom scan over a period of 1 s. The Ultrazoom scan is used as the LTQ instrument will only record data during an rf scan and this choice minimizes the change in rf amplitude, thus limiting the change in ion secular frequency. In other experiments, the same waveforms were applied, but their frequencies were ramped linearly with time from low to high frequency (high to low mass). All auxiliary waveforms were triggered at the beginning of the mass scan with the trigger tools in the LTQ Tune diagnostics menu. Resolution is reported as $m/\Delta m$, where $\Delta m$ is the full width at half maximum (FWHM).

Double resonance ejection at arbitrary frequencies was accomplished by synthesizing a single dipolar waveform with two frequency components. The first frequency was set to any arbitrary frequency. The second frequency was set, in this embodiment, on the corresponding lower sideband frequency, but note that any other characteristic frequency can be used. For example, with a driving rf frequency of 1 MHz, the two frequency components would be an arbitrarily chosen frequency of 300 kHz and 1,000−300=700 kHz (the lower sideband).

The results of one such embodiment at $\beta=0.83$ with an Ultramark 1621 calibration solution are shown in FIG. 1. As with previous multi-resonance experiments, resolution in the double resonance scan (dotted blue trace) is markedly superior to single resonance ejection (solid orange trace). Table 1 compares the resolution obtained from single and double resonance. On average, resolution is more than tripled from the classical resonance ejection scan. Note that the table is for constant scan rates, in order to keep the comparison fair since resolution will vary with scan rate. Also advantageous is the simplicity of the experiment since i) no higher order resonances are needed and ii) only a single dipolar waveform is used, in contrast to triple resonance with parametric and dipolar excitation. The peak width improvement is similar to triple resonance ejection, despite the lack of the hexapolar resonance (33% difference in triple resonance mode compared to 44% difference here).

TABLE 1

Double resonance ejection at secular and sideband frequencies more than triples mass resolution achieved using a benchtop LTQ linear ion trap

| | Resolution (m/Δm) | | Improvement |
|---|---|---|---|
| m/z | Single Resonance | Double Resonance | Factor |
| 1121.99758 | 2116.98 | 7299.92 | 3.45 |
| 1221.99119 | 2443.98 | 11109.01 | 4.55 |
| 1321.98481 | 2643.97 | 8012.03 | 3.03 |
| 1421.97842 | 2682.98 | 7891.11 | 2.94 |
| 1521.97203 | 2174.25 | 4348.49 | 2.00 |
| 1621.96564 | 2574.55 | 10727.29 | 4.17 |
| Average | 2439.45 | 8231.31 | 3.37 |

Table 1 shows resolution, measured at 50% peak height (FWHM), for several peaks in the Ultramark 1621 calibration solution obtained by single and double resonance ejection at $\beta=0.83$ (scan parameters in FIG. 1). Improvement factor is defined as the ratio of the resolution of double resonance and single resonance.

Figure 2:
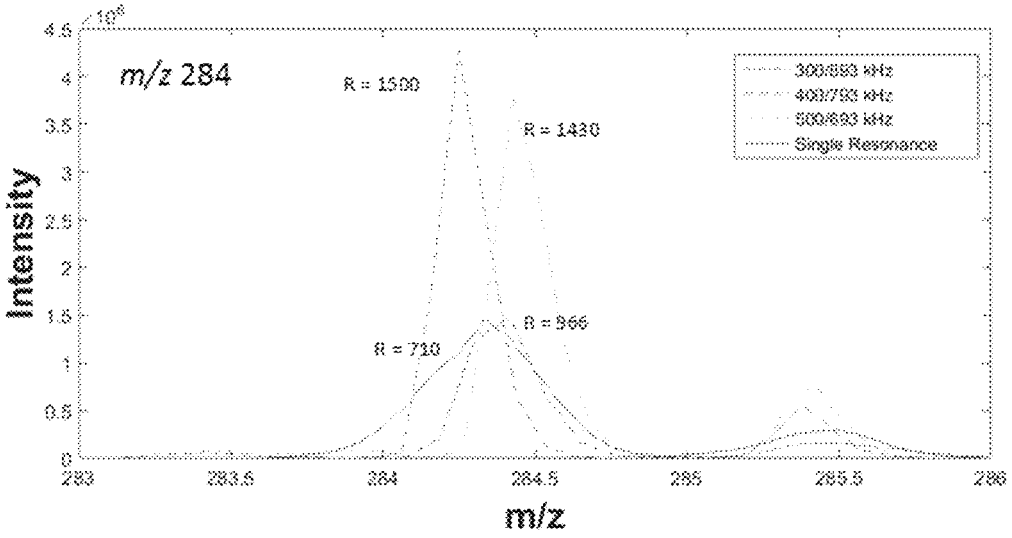
FIG. 2 shows double resonance ejection at arbitrary frequencies. Plot shows m/z 284 and its carbon isotope peak for double resonance ejection at the specified frequencies (secular frequency/lower sideband frequency). The analytes were quaternary ammonium ions m/z 284, 360, and 382. The rf amplitude was ramped from m/z 50 to m/z 1000 during a normal LTQ mass scan. In the double resonance experiments, the given frequencies were summed together (4 Vpp each) on an external function generator and applied to the linear trap as a single ejection waveform. Solid purple trace shows resonance ejection using the LTQ's built-in normal scan function.

The new double resonance method derives advantages from its versatility since any arbitrary frequency can be used for ejection. FIG. 2 demonstrates double resonance ejection at primary resonance frequencies of 300, 400, and 500 kHz ($\beta z=0.51$, $\beta z=0.68$, and $\beta z=0.85$, respectively), all of which show exceptional resolution when compared to the built-in resonance ejection scan of the commercial LTQ instrument (solid purple trace).

Figure 3:
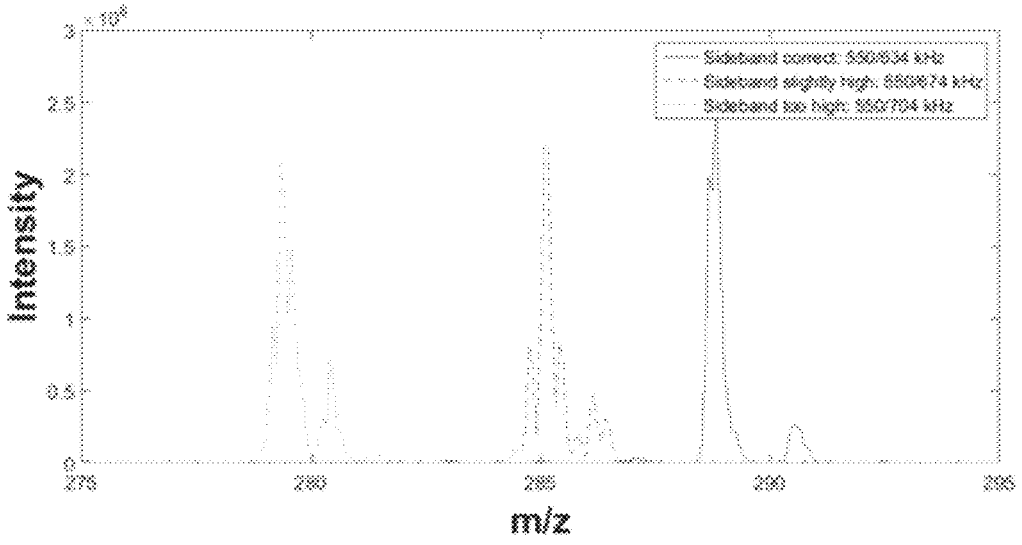
FIG. 3 shows frequency matching in double resonance ejection. If the sideband frequency is set correctly to match the lower resonance frequency applied (solid blue trace), mass resolution nearly doubles. However, if the lower sideband frequency is set slightly high (dotted orange trace, middle), erroneous peaks resembling isotopes appear. If the sideband frequency is set lower, resonance ejection at the sideband frequency, rather than at the fundamental secular frequency, is performed (yellow trace on left). Note that only the orange trace is mass calibrated.

When performing double resonance ejection, the resonance frequencies must be carefully matched experimentally, and phase considerations should also be taken into account. While it was observed that the phases of the multiple waveforms did not significantly affect the results, frequency matching was important. FIG. 3 illustrates the resulting spectra for correct and incorrect matches. When the two applied frequencies coincide (solid blue trace), resolution increases dramatically. However, when the sideband frequency is set slightly too high (dotted orange trace, middle), peak shapes consistently and erroneously resemble isotope peaks, though no isotopes corresponding to those peaks exist (confirmed with high-resolution measurements on an Orbitrap). If the sideband frequency is set too high, the resulting spectrum is a result of single resonance ejection at the sideband frequency.

As an alternative to summing the two resonance frequencies, amplitude modulation of a single frequency signals could be used with very similar results. Data shown in FIGS. 5A-B establish the near three fold improvement over simple resonance ejection.

Double resonance can similarly be used to improve the resolution in secular frequency scanning, which is an interesting alternative to ramping the rf amplitude. In this method, the frequency of the auxiliary ac signal is ramped to eject ions when their static secular frequencies match the varying ac frequency. In other words, the "hole" on the Mathieu stability diagram imposed by the supplementary ac is scanned while the rf amplitude is constant, whereas in resonance ejection ions are scanned through the hole by ramping the rf amplitude, which increases ion secular frequencies until they are ejected.

Figure 6A:
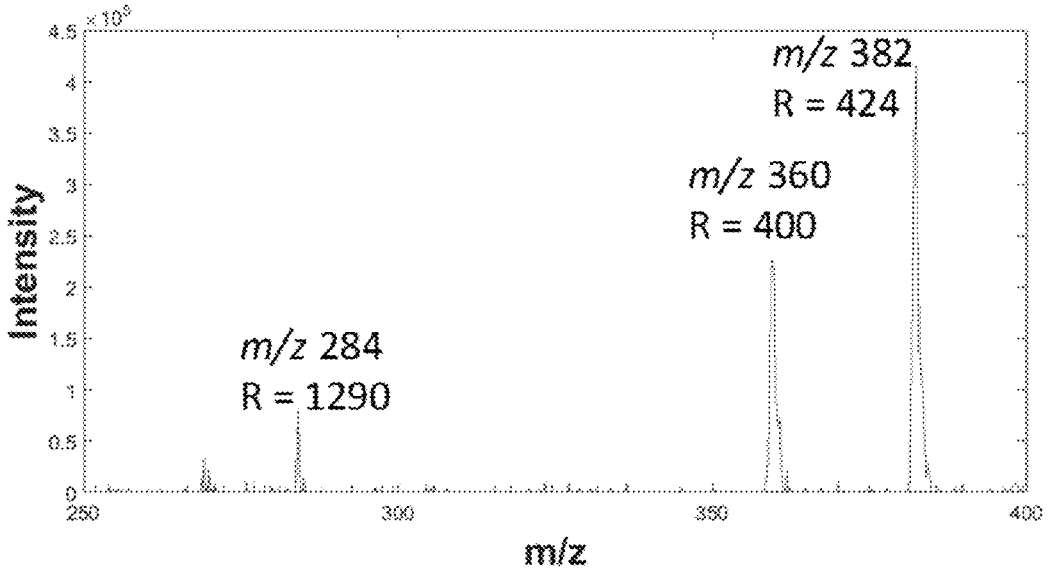
FIGS. 6A-D show double resonance secular frequency scanning.
Figure 6B:
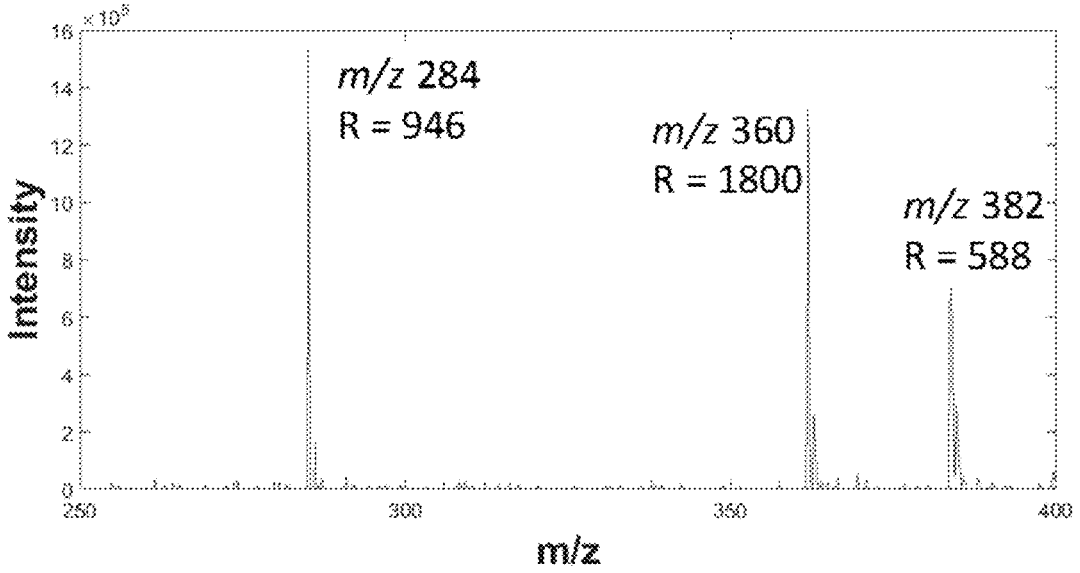
Figure 6C:
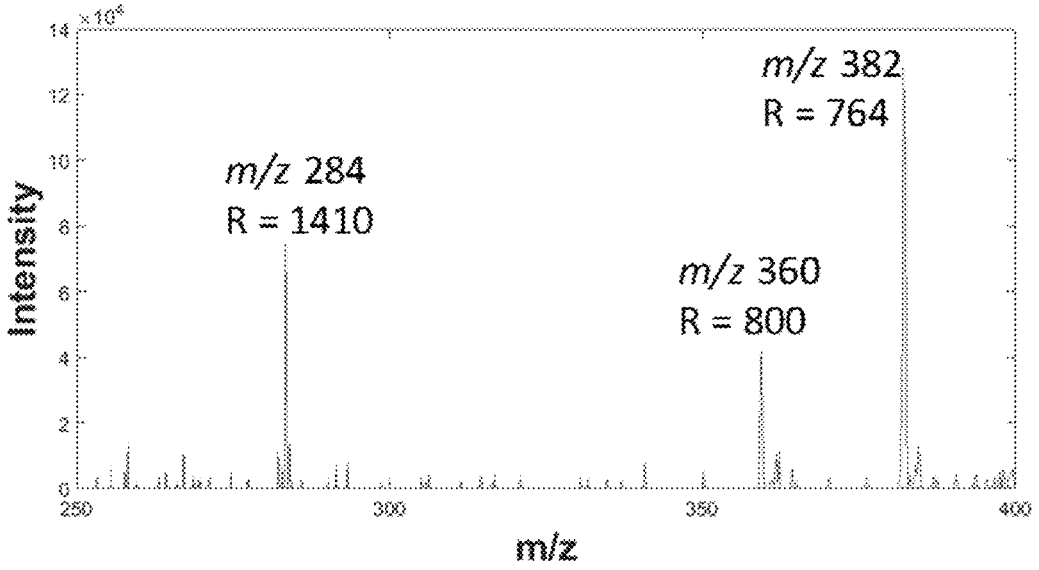
Figure 6D:
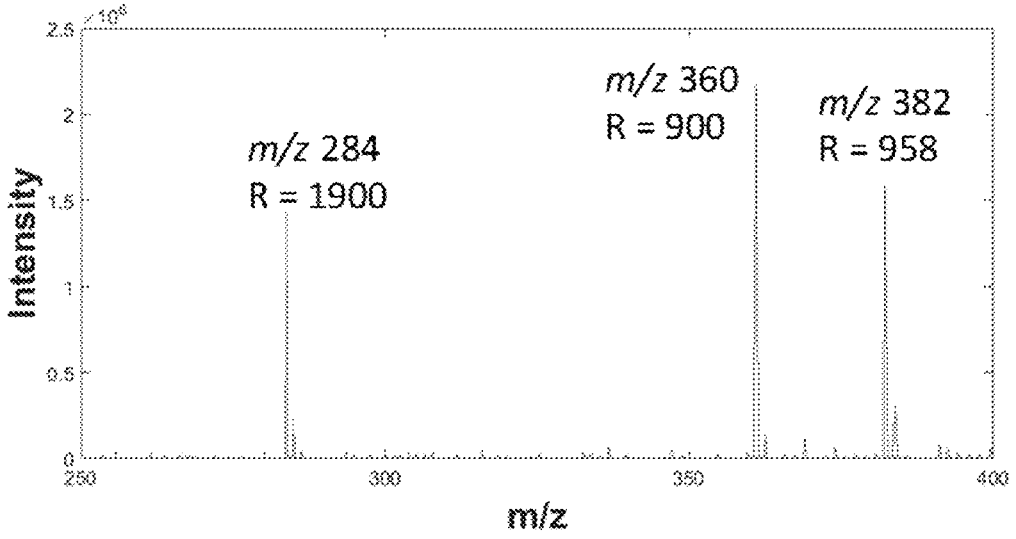

FIGS. 6A-D demonstrate increases in mass resolution in secular frequency scanning by using a double resonance method for a mixture of three quaternary ammonium ions. In this case, however, the secular and sideband frequencies must be ramped so that the frequencies coincide at all points in time. Both forward and reverse frequency sweeps were investigated. The increase in resolution in FIGS. 6C-D compared to FIGS. 6A-B is remarkable, almost a factor of two. In the spectrum shown in FIG. 6A, only the carbon isotope corresponding to m/z 285 is resolved. However, when a second resonance is simultaneously interrogated by ramping a second higher amplitude waveform through the coinciding sideband frequencies in FIG. 6C, all carbon isotopes are baseline resolved. Similar results are obtained for the reverse frequency, forward mass sweep. Note that the apparent decrease in resolution for m/z 360 is an artifact of the relatively slow data collection imposed by the Ultrazoom scan (1 data point every ~0.3 ms). Interestingly, the carbon isotopes are also slightly mass shifted by ~1.5 Th (m/z 359.3 and 361.8, m/z 382.1 and 384.2 for FIG. 6C), despite the accuracy of the mass calibration procedure. Some of this error can be attributed to the slow data collection rate (~3-4 points per m/z), but this cannot account for all the mass error. Space charging may also play a role, which is indicated by the apparent difference in the mass shift in FIG. 6C compared to FIG. 6D (i.e. different scan direction).

Figure 7A:
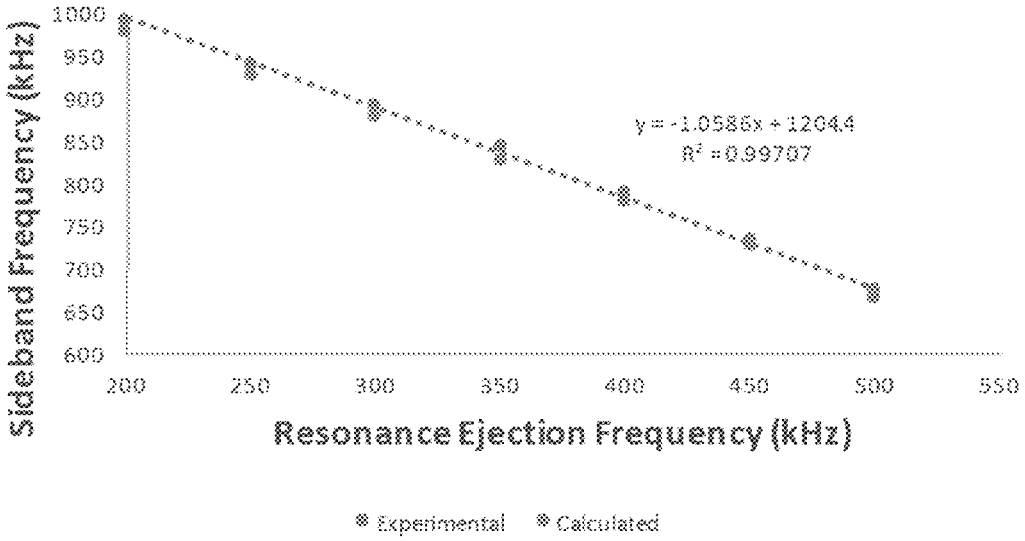
FIGS. 7A-C show Experimentally determined relationship between secular resonance ejection frequency and sideband/modulation frequency for (FIG. 7A) double resonance ejection with secular and sideband frequencies, (FIG. 7B) resonance ejection with amplitude modulation, and (FIG. 7C) double resonance secular frequency scanning. Comparisons are made between calculated and experimental values for all three types of experiments.
Figure 7B:
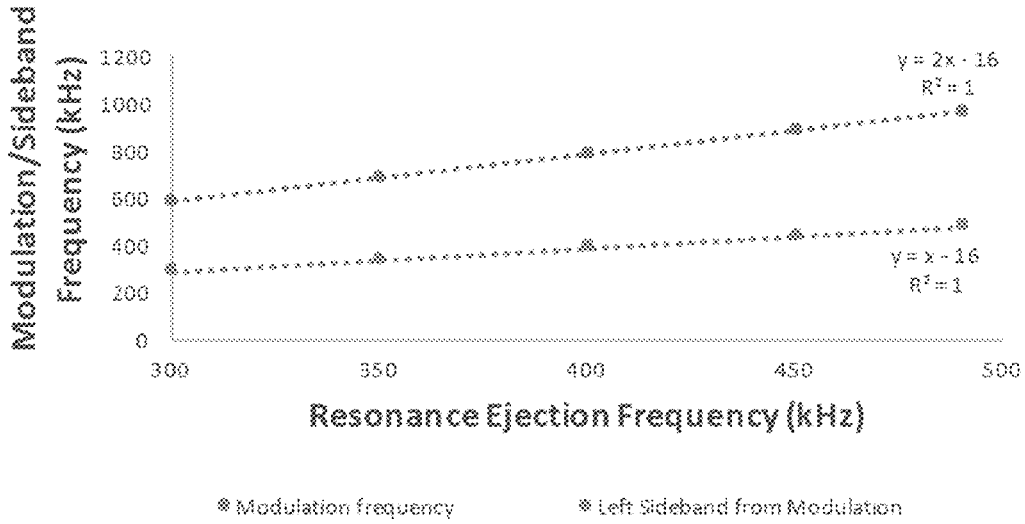
Figure 7C:
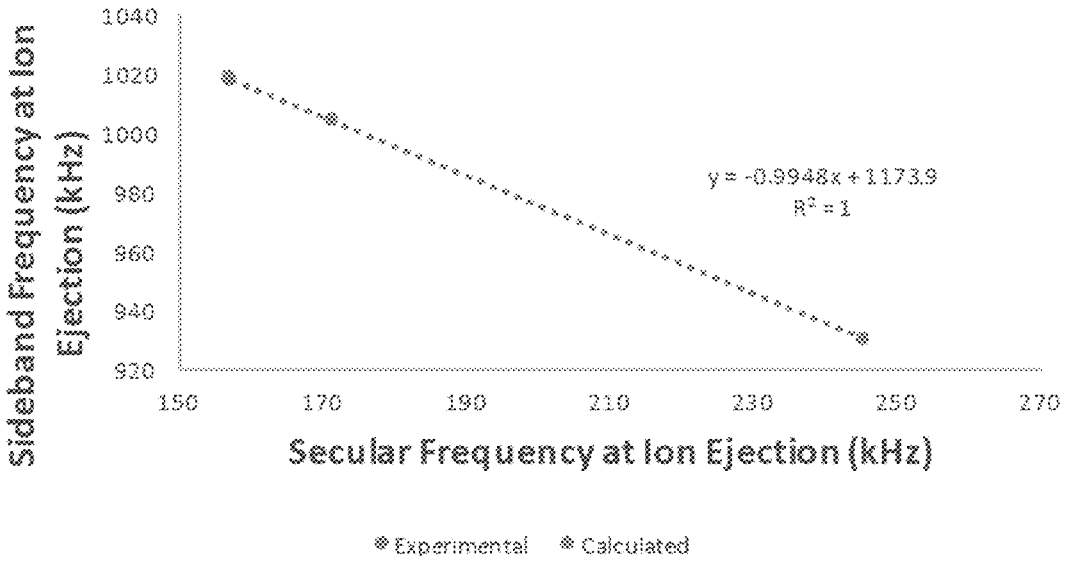

FIGS. 7A-C illustrate the relationship between the two frequency components in each type of scan. As shown in FIG. 7A, the determined sideband frequencies were, in general, slightly higher (lower in β-space) than values calculated from Ω−ω. For the amplitude modulation scans, the modulation frequency was determined by varying the modulation frequency until resolution was observed to increase. By modulating the resonance signal at a particular modulation frequency, $\omega_{mod}$, a primary frequency at $\omega_{mod}$ and two sideband frequencies at $\omega_{mod}-\omega_{res}$ and $\omega_{mod}-\omega_{res}$, where $\omega_{res}$ is the constant resonance frequency applied to the trap, are created. The reason for the increased resolution here is currently unknown, but amplitude modulation results closely mirror double resonance, implying that there may be a connection between the two. One possible explanation is that the $\beta_z$ values that the lower sideband corresponds to are approximately 0.03 below the $\beta_z$ that corresponds to the resonance ejection signal. Since the rf is ramped up, this implies that ions are first excited by the lower sideband generated by the modulation signal, which causes them to be more rapidly ejected when they come into resonance with the supplementary ac signal, which occurs at a slightly higher $\beta_z$. However, the primary resonance frequency should not appear in the waveform since it has been modulated, so another explanation is needed. In contrast to resonance ejection at static frequencies, frequencies calculated from Ω−ω corresponded quite closely to experimentally determined sideband frequencies in double resonance secular frequency scanning (FIG. 7C). Theoretical frequencies were obtained by subtracting the applied resonance frequency, ωres, from the rf frequency Ω. These frequencies were also experimentally determined for comparison.

The systems and methods described herein have many uses. For example, systems and methods of the invention can be used to perform ion mobility measurements, ion/molecule reactions, ion soft landing on surfaces, and other uses well known in the state of the art to which mass selected ions can be put. Double resonance fixed frequency ejection of ions from a substantially quadrupolar ion trap using a scan of the trapping rf amplitude to excite ions and generate fragments which are trapped and later ejected can be used to give a series of MS/MS product ion spectra associated with each activated precursor ion. In certain embodiments, the activated ions are used in ion spectroscopy.

Ion Generation

Any approach for generating ions known in the art may be employed. Exemplary mass spectrometry techniques that utilize ionization sources at atmospheric pressure for mass spectrometry include electrospray ionization (ESI; Fenn et al., Science, 246:64-71, 1989; and Yamashita et al., J. Phys. Chem., 88:4451-4459, 1984); atmospheric pressure ionization (APCI; Carroll et al., Anal. Chem. 47:2369-2373, 1975); and atmospheric pressure matrix assisted laser desorption ionization (AP-MALDI; Laiko et al. Anal. Chem., 72:652-657, 2000; and Tanaka et al. Rapid Commun. Mass Spectrom., 2:151-153, 1988). The content of each of these references in incorporated by reference herein its entirety.

Exemplary mass spectrometry techniques that utilize direct ambient ionization/sampling methods including desorption electrospray ionization (DESI; Takats et al., Science, 306:471-473, 2004 and U.S. Pat. No. 7,335,897); direct analysis in real time (DART; Cody et al., Anal. Chem., 77:2297-2302, 2005); Atmospheric Pressure Dielectric Barrier Discharge Ionization (DBDI; Kogelschatz, Plasma Chemistry and Plasma Processing, 23:1-46, 2003, and PCT international publication number WO 2009/102766), ion generation using a wetted porous material (Paper Spray, U.S. Pat. No. 8,859,956), and electrospray-assisted laser desorption/ionization (ELDI; Shiea et al., J. Rapid Communications in Mass Spectrometry, 19:3701-3704, 2005). The content of each of these references in incorporated by reference herein its entirety.

Ion generation can be accomplished by placing the sample on a porous material and generating ions of the sample from the porous material or other type of surface, such as shown in Ouyang et al., U.S. Pat. No. 8,859,956, the content of which is incorporated by reference herein in its entirety. Alternatively, the assay can be conducted and ions generated from a non-porous material, see for example, Cooks et al., U.S. patent application Ser. No. 14/209,304, the content of which is incorporated by reference herein in its entirety). In certain embodiments, a solid needle probe or surface to which a high voltage may be applied is used for generating ions of the sample (see for example, Cooks et al., U.S. patent application publication number 20140264004, the content of which is incorporated by reference herein in its entirety).

In certain embodiments, ions of a sample are generated using nanospray ESI. Exemplary nano spray tips and methods of preparing such tips are described for example in Wilm et al. (Anal. Chem. 2004, 76, 1165-1174), the content of which is incorporated by reference herein in its entirety. NanoESI is described for example in Karas et al. (Fresenius J Anal Chem. 2000 March-April; 366(6-7):669-76), the content of which is incorporated by reference herein in its entirety.

Ion Analysis

Figure 8:
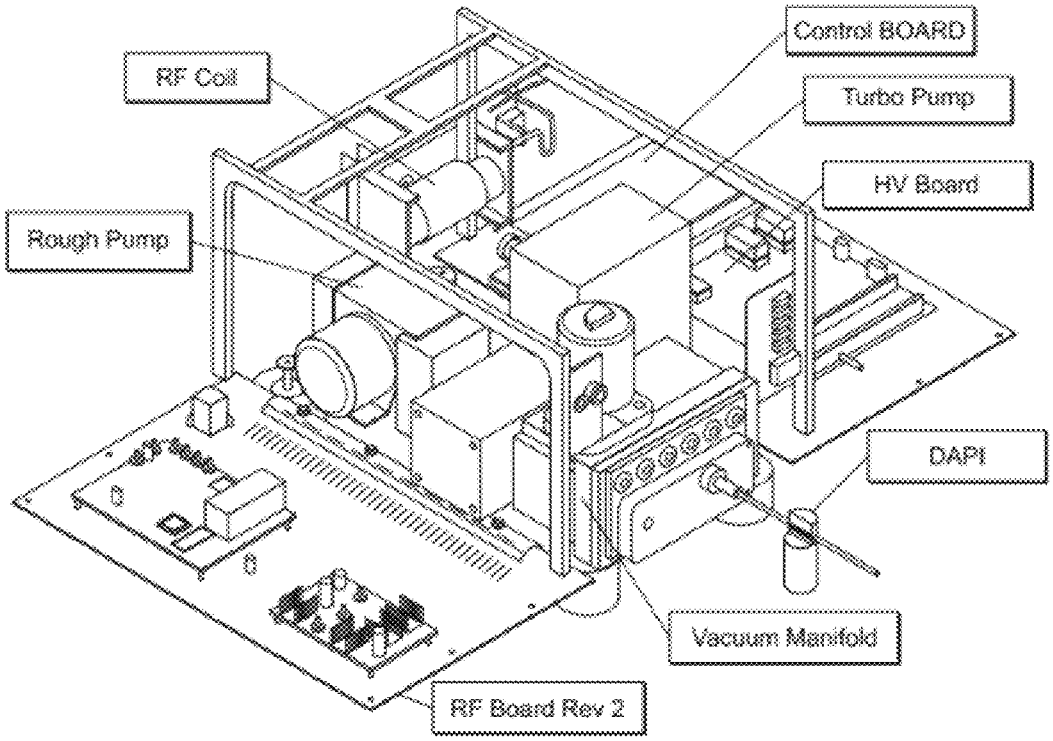
FIG. 8 is a picture illustrating various components and their arrangement in a miniature mass spectrometer.

In certain embodiments, the ions are analyzed by directing them into a mass spectrometer (bench-top or miniature mass spectrometer). FIG. 8 is a picture illustrating various components and their arrangement in a miniature mass spectrometer. The control system of the Mini 12 (Linfan Li, Tsung-Chi Chen, Yue Ren, Paul I. Hendricks, R. Graham Cooks and Zheng Ouyang "Miniature Ambient Mass Analysis System" Anal. Chem. 2014, 86 2909-2916, DOI: 10.1021/ac403766c; and 860. Paul I. Hendricks, Jon K. Dalgleish, Jacob T. Shelley, Matthew A. Kirleis, Matthew T. McNicholas, Linfan Li, Tsung-Chi Chen, Chien-Hsun Chen, Jason S. Duncan, Frank Boudreau, Robert J. Noll, John P. Denton, Timothy A. Roach, Zheng Ouyang, and R. Graham Cooks "Autonomous in-situ analysis and real-time chemical detection using a backpack miniature mass spectrometer: concept, instrumentation development, and performance" Anal. Chem., 2014, 86 2900-2908 DOI: 10.1021/ac403765x, the content of each of which is incorporated by reference herein in its entirety), and the vacuum system of the Mini 10 (Liang Gao, Qingyu Song, Garth E. Patterson, R. Graham Cooks and Zheng Ouyang, "Handheld Rectilinear Ion Trap Mass Spectrometer", Anal. Chem., 78 (2006) 5994-6002 DOI: 10.1021/ac061144k, the content of which is incorporated by reference herein in its entirety) may be combined to produce the miniature mass spectrometer shown in FIG. 8. It may have a size similar to that of a shoebox (H20×W25 cm×D35 cm). In certain embodiments, the miniature mass spectrometer uses a dual LIT configuration, which is described for example in Owen et al. (U.S. patent application Ser. No. 14/345,672), and Ouyang et al. (U.S. patent application Ser. No. 61/865,377), the content of each of which is incorporated by reference herein in its entirety.

The mass spectrometer (miniature or benchtop), may be equipped with a discontinuous interface. A discontinuous interface is described for example in Ouyang et al. (U.S. Pat.

No. 8,304,718) and Cooks et al. (U.S. patent application publication number 2013/0280819), the content of each of which is incorporated by reference herein in its entirety.

Collection of Ions

Systems and methods for collecting ions that have been analyzed by a mass spectrometer are shown in Cooks, (U.S. Pat. No. 7,361,311), the content of which is incorporated by reference herein in its entirety. Generally, the preparation of microchips arrays of molecules first involves the ionization of analyte molecules in the sample (solid or liquid). The molecules can be ionized by any of the methods discussed above. The ions can then be focused and collected using methods described below or can first be separated based on their mass/charge ratio or their mobility or both their mass/charge ratio and mobility. For example, the ions can be accumulated in an ion storage device such as a quadrupole ion trap (Paul trap, including the variants known as the cylindrical ion trap and the linear ion trap) or an ion cyclotron resonance (ICR) trap. Either within this device or using a separate mass analyzer (such as a quadrupole mass filter or magnetic sector or time of flight), the stored ions are separated based on mass/charge ratios. Additional separation might be based on mobility using ion drift devices or the two processes can be integrated. The separated ions are then deposited on a microchip or substrate at individual spots or locations in accordance with their mass/charge ratio or their mobility to form a microarray.

To achieve this, the microchip or substrate is moved or scanned in the x-y directions and stopped at each spot location for a predetermined time to permit the deposit of a sufficient number of molecules to form a spot having a predetermined density. Alternatively, the gas phase ions can be directed electronically or magnetically to different spots on the surface of a stationary chip or substrate. The molecules are preferably deposited on the surface with preservation of their structure, that is, they are soft-landed. Two facts make it likely that dissociation or denaturation on landing can be avoided. Suitable surfaces for soft-landing are chemically inert surfaces that can efficiently remove vibrational energy during landing, but which will allow spectroscopic identification. Surfaces which promote neutralization, rehydration or having other special characteristics might also be used for protein soft-landing.

Generally, the surface for ion landing is located after the ion focusing device, and in embodiments where ions are first separated, the surface is located behind the detector assembly of the mass spectrometer. In the ion detection mode, the high voltages on the conversion dynode and the multiplier are turned on and the ions are detected to allow the overall spectral qualities, signal-to-noise ratio and mass resolution over the full mass range to be examined. In the ion-landing mode, the voltages on the conversion dynode and the multiplier are turned off and the ions are allowed to pass through the hole in the detection assembly to reach the landing surface of the plate (such as a gold plate). The surface is grounded and the potential difference between the source and the surface is 0 volts.

An exemplary substrate for soft landing is a gold substrate (20 mm×50 mm, International Wafer Service). This substrate may consist of a Si wafer with 5 nm chromium adhesion layer and 200 nm of polycrystalline vapor deposited gold. Before it is used for ion landing, the substrate is cleaned with a mixture of $H_2SO_4$ and $H_2O_2$ in a ratio of 2:1, washed thoroughly with deionized water and absolute ethanol, and then dried at 150° C. A Teflon mask, 24 mm×71 mm with a hole of 8 mm diameter in the center, is used to cover the gold surface so that only a circular area with a diameter of 8 mm on the gold surface is exposed to the ion beam for ion soft-landing of each mass-selected ion beam. The Teflon mask is also cleaned with 1:1 MeOH:$H_2O$ (v/v) and dried at elevated temperature before use. The surface and the mask are fixed on a holder and the exposed surface area is aligned with the center of the ion optical axis.

Any period of time may be used for landing of the ions. Between each ion-landing, the instrument is vented, the Teflon mask is moved to expose a fresh surface area, and the surface holder is relocated to align the target area with the ion optical axis. After soft-landing, the Teflon mask is removed from the surface.

In another embodiment a linear ion trap can be used as a component of a soft-landing instrument. Ions travel through a heated capillary into a second chamber via ion guides in chambers of increasing vacuum. The ions are captured in the linear ion trap by applying suitable voltages to the electrodes and RF and DC voltages to the segments of the ion trap rods. The stored ions can be radially ejected for detection. Alternatively, the ion trap can be operated to eject the ions of selected mass through the ion guide, through a plate onto the microarray plate. The plate can be inserted through a mechanical gate valve system without venting the entire instrument.

The advantages of the linear quadrupole ion trap over a standard Paul ion trap include increased ion storage capacity and the ability to eject ions both axially and radially. Linear ion traps give unit resolution to at least 2000 Thomspon (Th) and have capabilities to isolate ions of a single mass/charge ratio and then perform subsequent excitation and dissociation in order to record a product ion MS/MS spectrum. Mass analysis will be performed using resonant waveform methods. The mass range of the linear trap (2000 Th or 4000 Th but adjustable to 20,000 Th) will allow mass analysis and soft-landing of most molecules of interest. In the soft-landing instrument described above the ions are introduced axially into the mass filter rods or ion trap rods. The ions can also be radially introduced into the linear ion trap.

Methods of operating the above described soft-landing instruments and other types of mass analyzers to soft-land ions of different masses at different spots on a microarray are now described. The ions of the functionalized analyte from the sample are introduced into the mass filter. Ions of selected mass-to-charge ratio will be mass-filtered and soft-landed on the substrate for a period of time. The mass-filter settings then will be scanned or stepped and corresponding movements in the position of the substrate will allow deposition of the ions at defined positions on the substrate.

The ions can be separated in time so that the ions arrive and land on the surface at different times. While this is being done the substrate is being moved to allow the separated ions to be deposited at different positions. A spinning disk is applicable, especially when the spinning period matches the duty cycle of the device. The applicable devices include the time-of-flight and the linear ion mobility drift tube. The ions can also be directed to different spots on a fixed surface by a scanning electric or magnetic fields.

In another embodiment, the ions can be accumulated and separated using a single device that acts both as an ion storage device and mass analyzer. Applicable devices are ion traps (Paul, cylindrical ion trap, linear trap, or ICR). The ions are accumulated followed by selective ejection of the ions for soft-landing. The ions can be accumulated, isolated as ions of selected mass-to-charge ratio, and then soft-landed onto the substrate. Ions can be accumulated and landed simultaneously. In another example, ions of various mass-to-charge ratios are continuously accumulated in the ion trap while at the same time ions of a selected mass-to-charge ratio can be ejected using SWIFT and soft-landed on the substrate.

In a further embodiment of the soft-landing instrument ion mobility, is used as an additional (or alternative) separation parameter. As before, ions are generated by a suitable ionization source, such as those described herein. The ions are then subjected to pneumatic separation using a transverse air-flow and electric field. The ions move through a gas in a direction established by the combined forces of the gas flow and the force applied by the electric field. Ions are separated in time and space. The ions with the higher mobility arrive at the surface earlier and those with the lower mobility arrive at the surface later at spaces or locations on the surface.

The instrument can include a combination of the described devices for the separation and soft-landing of ions of different masses at different locations. Two such combinations include ion storage (ion traps) plus separation in time (TOF or ion mobility drift tube) and ion storage (ion traps) plus separation in space (sectors or ion mobility separator).

It is desirable that the structure of the analyte be maintained during the soft-landing process. On such strategy for maintaining the structure of the analyte upon deposition involves keeping the deposition energy low to avoid dissociation or transformation of the ions when they land. This needs to be done while at the same time minimizing the spot size. Another strategy is to mass select and soft-land an incompletely desolvated form of the ionized molecule. Extensive hydration is not necessary for molecules to keep their solution-phase properties in gas-phase. Hydrated molecular ions can be formed by electrospray and separated while still "wet" for soft-landing. The substrate surface can be a "wet" surface for soft-landing, this would include a surface with as little as one monolayer of water. Another strategy is to hydrate the molecule immediately after mass-separation and prior to soft-landing. Several types of mass spectrometers, including the linear ion trap, allow ion/molecule reactions including hydration reactions. It might be possible to control the number of water molecules of hydration. Still further strategies are to deprotonate the mass-selected ions using ion/molecule or ion/ion reactions after separation but before soft-landing, to avoid undesired ion/surface reactions or protonate at a sacrificial derivatizing group which is subsequently lost.

Different surfaces are likely to be more or less well suited to successful soft-landing. For example, chemically inert surfaces which can efficiently remove vibrational energy during landing may be suitable. The properties of the surfaces will also determine what types of in situ spectroscopic identification are possible. The ions can be soft-landed directly onto substrates suitable for MALDI. Similarly, soft-landing onto SERS-active surfaces should be possible. In situ MALDI and secondary ion mass spectrometry can be performed by using a bi-directional mass analyzer such as a linear trap as the mass analyzer in the ion deposition step and also in the deposited material analysis step.

System Architecture

Figure 9:
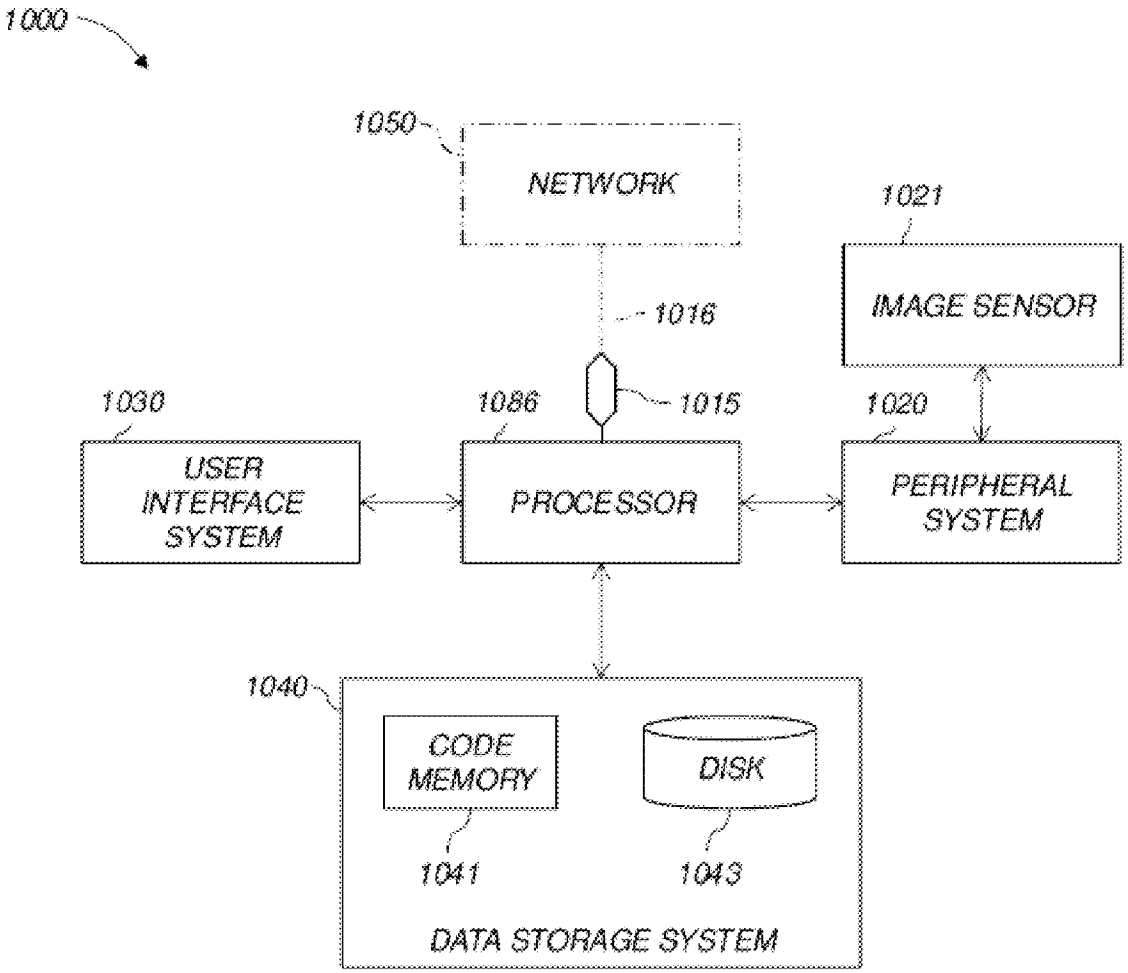
FIG. 9 shows a high-level diagram of the components of an exemplary data-processing system for analyzing data and performing other analyses described herein, and related components.

FIG. 9 is a high-level diagram showing the components of an exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The data described above may be obtained using detector 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 which in one embodiment may be capable of real-time calculations (and in an alternative embodiment configured to perform calculations on a non-real-time basis and store the results of calculations for use later) can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (e.g., a tablet) connected, e.g., via a network or a null-modem cable, or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), Universal Serial Bus (USB) interface memory device, erasable programmable read-only memories (EPROM, EEPROM, or Flash), remotely accessible hard drives, and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors) to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Sample

The systems of the invention can be used to analyze many different types of samples. A wide range of heterogeneous samples can be analyzed, such as biological samples, environmental samples (including, e.g., industrial samples and agricultural samples), and food/beverage product samples, etc.).

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a prefilter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected. More particularly, systems of the invention can be used to detect molecules in a biological sample that are indicative of a disease state. Specific examples are provided below.

Where one or more of the target molecules in a sample are part of a cell, the aqueous medium may also comprise a lysing agent for lysing of cells. A lysing agent is a compound or mixture of compounds that disrupt the integrity of the membranes of cells thereby releasing intracellular contents of the cells. Examples of lysing agents include, but are not limited to, non-ionic detergents, anionic detergents, amphoteric detergents, low ionic strength aqueous solutions (hypotonic solutions), bacterial agents, aliphatic aldehydes, and antibodies that cause complement dependent lysis, for example. Various ancillary materials may be present in the dilution medium. All of the materials in the aqueous medium are present in a concentration or amount sufficient to achieve the desired effect or function.

In some examples, where one or more of the target molecules are part of a cell, it may be desirable to fix the cells of the sample. Fixation of the cells immobilizes the cells and preserves cell structure and maintains the cells in a condition that closely resembles the cells in an in vivo-like condition and one in which the antigens of interest are able to be recognized by a specific affinity agent. The amount of fixative employed is that which preserves the cells but does not lead to erroneous results in a subsequent assay. The amount of fixative may depend for example on one or more of the nature of the fixative and the nature of the cells. In some examples, the amount of fixative is about 0.05% to about 0.15% or about 0.05% to about 0.10%, or about 0.10% to about 0.15% by weight. Agents for carrying out fixation of the cells include, but are not limited to, cross-linking agents such as, for example, an aldehyde reagent (such as, e.g., formaldehyde, glutaraldehyde, and paraformaldehyde); an alcohol (such as, e.g., $C_1$-$C_5$ alcohols such as methanol, ethanol and isopropanol); a ketone (such as a $C_3$-$C_5$ ketone such as acetone); for example. The designations $C_1$-$C_5$ or $C_3$-$C_5$ refer to the number of carbon atoms in the alcohol or ketone. One or more washing steps may be carried out on the fixed cells using a buffered aqueous medium.

If necessary after fixation, the cell preparation may also be subjected to permeabilization. In some instances, a fixation agent such as, an alcohol (e.g., methanol or ethanol) or a ketone (e.g., acetone), also results in permeabilization and no additional permeabilization step is necessary. Permeabilization provides access through the cell membrane to target molecules of interest. The amount of permeabilization agent employed is that which disrupts the cell membrane and permits access to the target molecules. The amount of permeabilization agent depends on one or more of the nature of the permeabilization agent and the nature and amount of the cells. In some examples, the amount of permeabilization agent is about 0.01% to about 10%, or about 0.1% to about 10%. Agents for carrying out permeabilization of the cells include, but are not limited to, an alcohol (such as, e.g., $C_1$-$C_5$ alcohols such as methanol and ethanol); a ketone (such as a $C_3$-$C_5$ ketone such as acetone); a detergent (such as, e.g., saponin, TRITON X-100 (4-(1,1,3,3-Tetramethylbutyl)phenyl-polyethylene glycol, t-Octylphenoxypolyethoxyethanol, Polyethylene glycol tert-octylphenyl ether buffer, commercially available from Sigma Aldrich), and TWEEN-20 (Polysorbate 20, commercially available from Sigma Aldrich)). One or more washing steps may be carried out on the permeabilized cells using a buffered aqueous medium.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

Ions of particular m/z values have multiple resonance frequencies at which they can be excited and ejected from a quadrupole ion trap. These resonances consist of the fundamental secular frequency, which is most often used for dipolar resonance ejection, as well as higher order quadrupolar resonances, other higher order (e.g. hexapolar and octopolar) resonances, and sideband frequencies of the rf driving frequency. Double and triple resonance ejection experiments have previously been shown to increase resolution in ion traps in work that was limited to the application of static frequencies which correspond to hexapole or octopole resonances accessed by conventional rf amplitude scans. A double resonance method which could be applied using either a ramped or fixed rf amplitude at any arbitrary static or dynamic frequency in ion traps with various higher-order field contributions would be even more useful.

The Examples herein show that double resonance ejection was performed by combining two frequency components corresponding to the fundamental secular frequency and the first lower sideband frequency. The resulting waveform can directly replace the resonance ejection waveform in a benchtop linear ion trap mass spectrometer operated under otherwise normal resonance ejection (rf amplitude scan) conditions. In a variant of the method, amplitude modulation was used to improve mass resolution. Secular frequency scanning, an alternative method of recording mass spectra, can also be improved by using both frequencies and ramping them linearly at constant rf amplitude to effect a double resonance secular frequency scan.

The data herein show that double resonance ejection with either static or dynamic frequencies more than triples the resolution of an ion trap compared to operation using rf amplitude scans at fixed frequency and to double resolution in dynamic frequency scans. Phase-locked double resonance experiments on the Mini 12 mass spectrometer were also performed. The method is shown to be applicable to any arbitrary static or dynamic resonance frequency, improving versatility and increasing resolution regardless of frequency and method.

Accordingly, the data herein show methods of increasing mass resolution by using double resonance ejection at any arbitrary fixed or varying frequency. Significant improvement in mass resolution of a benchtop instrument is seen.

Example 1: Materials and Methods

Ionization: Ions were generated by nanoelectrospray ionization (nESI) at ~2 kV. Typical spray tip diameters were ~5 micrometers.

Chemicals: Didodecyldimethylammonium bromide was purchased from Sigma Aldrich (St. Louis, Mo., USA), hexadecyltrimethylammonium bromide was purchased from Tokyo Chemical Industry Co. (Tokyo, Japan), and benzylhexadecyldimethylammonium chloride was purchased from JT Baker Chemical Co (Phillipsburg, N.J., USA). Tetraheptylammonium chloride was purchased from Fluka, tetrabutylammonium iodide was obtained from Fluka, tetrahexylammonium bromide was obtained from Fluka, and tetraoctylammonium bromide was purchased from Aldrich. Reagents were dissolved in HPLC grade methanol and then diluted in 50:50 MeOH:$H_2O$ with 0.1% formic acid to final concentrations of ~5 ppm. Ultramark 1621 calibration solution was obtained from Thermo Fisher (Rockford, Ill., USA).

Instrumentation: All experiments were performed using a Thermo LTQ XL linear ion trap mass spectrometer interfaced to an Orbitrap (San Jose, Calif., USA). The rf frequency was tuned to 1175 kHz. For static resonance ejection, the built-in normal scan function was used, but, unless otherwise specified, the resonance ejection signal was replaced with an ac waveform of specified frequency and amplitude. This waveform was supplied by a Keysight 33612A arbitrary waveform generator (Newark, S.C., USA). For double resonance ejection, two channels were set to different frequencies and summed into a single channel. One frequency was less than half the driving rf frequency and the other was set to the corresponding lower sideband $\Omega-\omega$, where $\omega$ represents the low frequency. General frequencies were 10-587.5 kHz and 587.5-1175 kHz, respectively. Double resonance secular frequency scanning was similarly performed during an Ultrazoom scan over a period of 1 s. The Ultrazoom scan is used as the LTQ instrument will only record data during an rf scan and this choice minimizes the change in rf amplitude, thus limiting the change in ion secular frequency. In the double resonance secular frequency scans, the same waveforms were applied, but their frequencies were ramped linearly with time from low to high frequency (high to low mass). All auxiliary waveforms were triggered at the beginning of the mass scan with the trigger tools in the LTQ Tune diagnostics menu but were not phase-locked to the driving rf.

Resolution is reported as $m/\Delta m$, where $\Delta m$ is the full width at half maximum (FWHM).

Example 2: Double Resonance Ejection

Double resonance ejection at arbitrary frequencies was accomplished by synthesizing a single dipolar waveform with two frequency components. The first frequency is set to any arbitrary frequency. This is in contrast to previous reports of double (Wang et al., J. Mass Spectrom. 2013, 48, 937) and triple (Moxom et al., Rapid Commun Mass Spectrom 2002, 16, 755) resonance which were performed only at nonlinear resonance points. While these nonlinear resonance points increase resolution, their presence is not necessary for double resonance and indeed not necessary for improving resolution. The second frequency was set on the corresponding lower sideband frequency. This frequency was chosen because of its magnitude. The frequency spectrum of ion motion in a pure quadrupole ion trap is dominated by the secular frequency and the lower sideband, with small contributions from other sideband frequencies. Importantly, as an ion approaches the stability boundary, its motion becomes increasingly characteristic of the lower sideband frequency. Higher order resonance frequencies imposed by hexapole and octopole fields may be used, but the requirement for a significant contribution from hexapole and octopole field components makes them less broadly applicable. For these reasons, the lower sideband was chosen as the second resonance frequency, but other frequencies may be used with higher ac amplitudes. As an example, with a driving rf frequency of 1 MHz, the two frequency components would be an arbitrarily chosen frequency of 300 kHz and a lower sideband frequency of 1,000−300=700 kHz.

The results of one such experiment at $\beta$=0.83 with an Ultramark 1621 calibration solution are shown in FIG. 1. The amplitude chosen for the sideband resonance should be significantly higher than for the secular resonance due to its smaller contribution to ion motion. Even so, amplitudes <10 $V_{pp}$ easily gave much improved results. As with previous multi-resonance experiments, resolution in the double resonance scan (dotted blue trace) is markedly superior to single resonance ejection (solid red trace). Table 2 compares the resolution obtained from single and double resonance.

TABLE 2

Double resonance ejection at secular and sideband frequencies more than doubles mass resolution achieved using a benchtop Thermo LTQ linear ion trap

| | Resolution (m/Am) | | Improvement |
|---|---|---|---|
| m/z | Single Resonance | Double Resonance | Factor |
| 1121.99758 | 2116.98 | 7299.92 | 3.45 |
| 1221.99119 | 2443.98 | 11109.01 | 4.55 |
| 1321.98481 | 2643.97 | 8012.03 | 3.03 |
| 1421.97842 | 2682.98 | 7891.11 | 2.94 |
| 1521.97203 | 2174.25 | 4348.49 | 2.00 |
| 1621.96564 | 2574.55 | 10727.29 | 4.17 |
| Average | 2439.45 | 8231.31 | 3.37 |

Table 2 shows resolution, measured at 50% peak height (FWHM), for several peaks in the Ultramark 1621 calibration solution obtained by single and double resonance ejection at $\beta$=0.83 (scan parameters in FIG. 1). Improvement factor is defined as the ratio of the resolution of double resonance and single resonance.

On average, resolution is more than tripled from the classical resonance ejection scan. Note that the table is for constant scan rates in order to keep the comparison fair since resolution will vary with scan rate. Also advantageous is the simplicity of the experiment since i) no higher order resonances are needed and ii) only a single dipolar waveform is used, in contrast to triple resonance with parametric and dipolar excitation. The peak width improvement is similar to triple resonance ejection, despite the lack of the hexapolar resonance (previously reported decrease in peak width from 18 ms to 12 ms, which is similar to the improvement in peak width reported here). Splendore et al., International Journal of Mass Spectrometry 1999, 191, 129.

The new method derives advantages from its versatility since any arbitrary frequency can be used for ejection. FIG. 2 demonstrates double resonance ejection at 300, 400, and 500 kHz ($\beta_z$=0.51, $\beta_z$=0.68, and $\beta_z$=0.85), all of which show exceptional resolution when compared to the built-in resonance ejection scan of the commercial LTQ instrument (solid purple trace). The resolution at 400 and 500 kHz is superior since the ejection $q_z$ is then more optimal than at low q values, which is a well-known phenomenon but beyond the scope of the current paper.

When performing double resonance ejection, the resonance waveforms must be carefully matched experimentally, both in terms of amplitude and frequency. The amplitude of the sideband waveform must be higher than that of the primary resonance frequency, as previously discussed. FIG. 3 illustrates the resulting spectra for correct and incorrect frequency matches. When the two applied frequencies coincide (solid blue trace), resolution increases dramatically. However, when the sideband frequency is set slightly too high (dotted orange trace, middle), peak shapes consistently and erroneously resemble isotope peaks, though no isotopes corresponding to those peaks exist (confirmed with high-resolution measurements on an Orbitrap). Peak splitting has previously been reported in double resonance experiments (Moxom et al., Rapid Commun Mass Spectrom 2002, 16, 755), and their cause is discussed in the next section. If the sideband frequency is set too high, the resulting spectrum is a result of single resonance ejection at the sideband frequency.

Figure 4A:
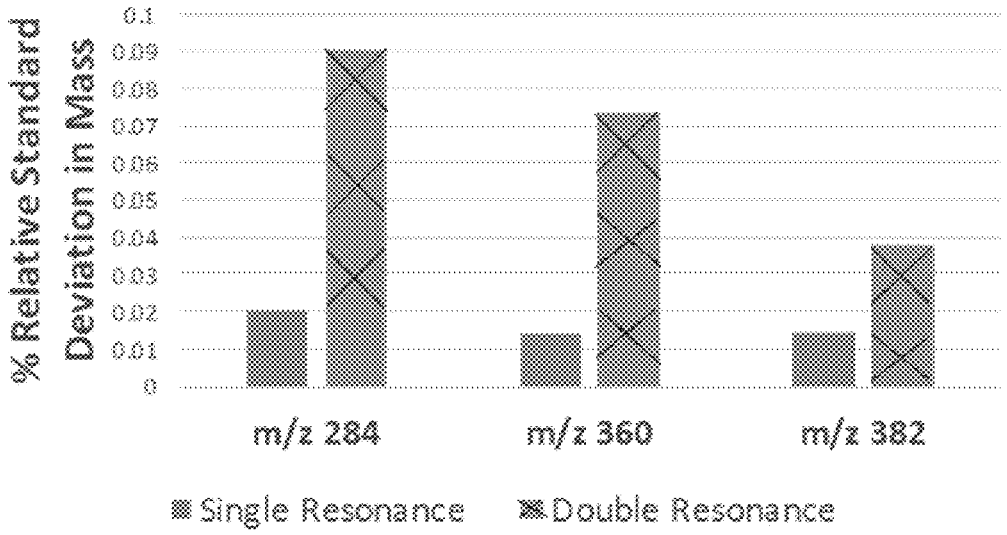
FIGS. 4A-C show the effect of phase-locking on mass precision in single and double resonance ejection using a Mini mass spectrometer.
Figure 4B:
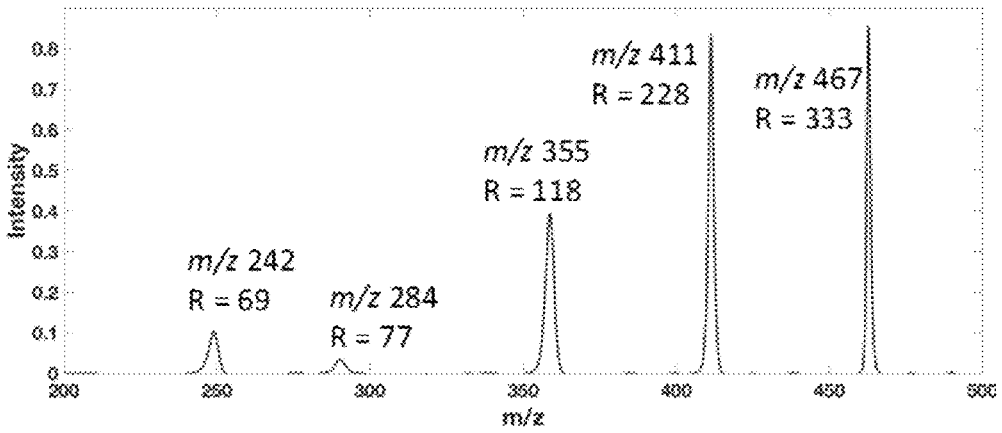
Figure 4C:
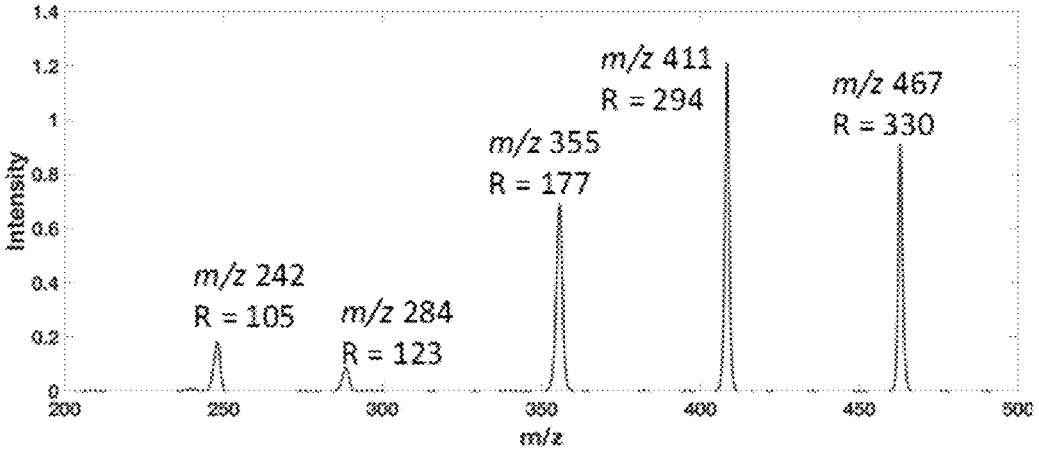

Although resolution is improved in this method, peak splitting in averaged mass spectra could occur. The precision of the mass measurements were sometimes decreased, as shown in FIGS. 4A-C, which compares the relative standard deviation of the measured mass for 15 single resonance ejection spectra with 15 double resonance ejection spectra (all performed using an LTQ XL). This is likely due to the phase relationship between the rf and the two ac waveforms (Doroshenko ET AL., Rapid Commun Mass Spectrom 1996, 10, 1921). The optimum mass accuracy is obtained when there is an integer relationship between the rf and the ac. In addition, the ac should be phase-locked to the rf to ensure that the field strength at a given time is consistent from scan to scan (Splendore et al., International Journal of Mass Spectrometry 1999, 191, 129). In order to test this hypothesis, single and double resonance ejection experiments were performed on the Mini 12 mass spectrometer (Snyder et al., Calibration procedure for secular frequency scanning in an ion trap and Li et al., Anal. Chem. 2014, 86, 2909, the content of each of which is incorporated by reference herein in its entirety). This system was chosen because the rf and ac are phase-locked, and the phase relationship can be varied. The resonance ejection waveform was provided by an external function generator triggered on a low-amplitude ac waveform from the Mini 12 ac/waveform board. Thus, the rf and the ac were phase-locked since the ac was triggered by a phase-locked signal (although the phase relationship between the rf and ac was unknown). FIGS. 4B-C compare the average of three spectra obtained by single and double resonance ejection. As shown, resolution is improved in the double resonance scan and no peak splitting is observed.

Figure 5A:
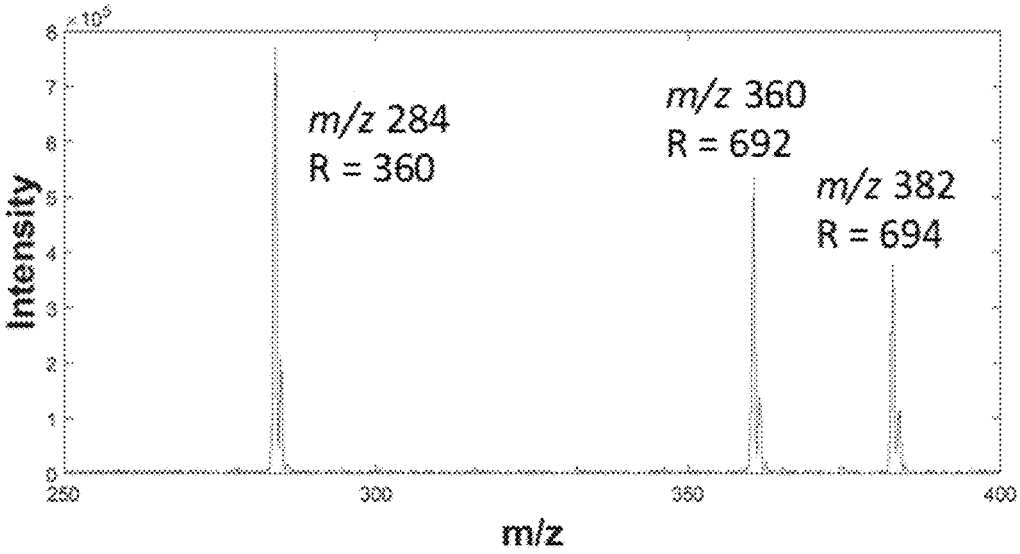
FIGS. 5A-B show Resonance ejection by amplitude modulation.
Figure 5B:
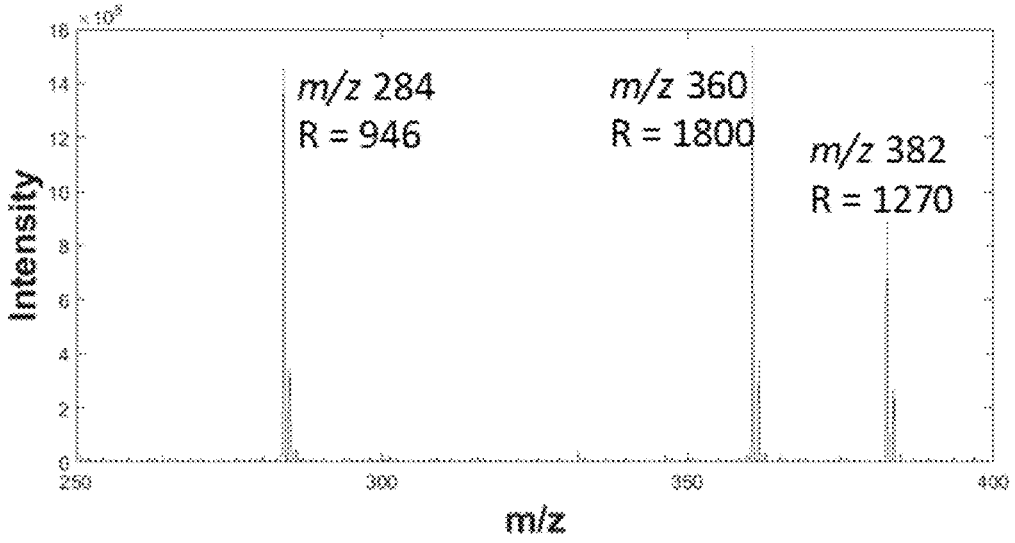

Similar results were also found in terms of the resolution that could be obtained by amplitude modulation (FIGS. 5A-B). The appropriate modulation frequencies were determined experimentally, as discussed later, and the resulting increase in resolution was almost 3-fold. This is perhaps an even simpler double resonance experiment since amplitude modulation is used rather than summing two sinusoids. In general, the $\beta_z$ value of the lower sideband that results from modulation are approximately 0.03 below the $\beta_z$ that corresponds to the resonance ejection signal. That is, the lower sideband corresponds to the main resonance frequency.

Double resonance can similarly be used to improve the resolution in secular frequency scanning, which is a simple and interesting alternative to ramping the rf amplitude. In this method, the frequency of the auxiliary ac signal is ramped to eject ions when their static secular frequencies match the varying ac frequency. In other words, the "hole" on the Mathieu stability diagram imposed by the supplementary ac is scanned while the rf amplitude is constant, whereas in resonance ejection ions are scanned through the hole by ramping the rf amplitude, which increases ion secular frequencies until they are ejected.

FIGS. 6A-D demonstrates increase in mass resolution in secular frequency scanning by using a double resonance method for a mixture of three quaternary ammonium ions. In this case, however, the secular and sideband frequencies are ramped so that the frequencies coincide at all points in time. Both forward and reverse frequency sweeps were investigated. It should be noted that the Ultrazoom scan decreases the resolution in forward frequency sweeps (opposite for reverse frequency sweeps) because ion secular frequencies move away from the scanned working point. The increase in resolution in the double resonance spectra in FIGS. 6C-D compared to FIGS. 6A-B is remarkable, almost a factor of two. In the spectrum shown in FIG. 6A, only the carbon isotope corresponding to m/z 285 is resolved. However, when a second resonance is simultaneously interrogated by ramping a second higher amplitude waveform through the coinciding sideband frequencies in FIG. 6C, all carbon isotopes are baseline resolved. Similar results are obtained for the reverse frequency, forward mass sweep. Note that the apparent decrease in resolution for m/z 360 is an artifact of the relatively slow data collection imposed by the Ultrazoom scan (1 data point every ~0.37 ms) and the calibration procedure. On average, the double resonance peak was 0.15 ms wide (10% valley), whereas the single resonance peak was 18.5 ms wide (10% valley). Interestingly, the carbon isotopes are also slightly mass shifted by ~1.5 Th (m/z 359.3 and 361.8, m/z 382.1 and 384.2 for (FIG. 6C)), despite the accuracy of the mass calibration procedure. Some of this error can be attributed to the slow data collection rate (~3-4 points per m/z), but this cannot account for all the mass error. Space charging may also play a role, which is indicated by the dissimilar carbon isotope mass shifts in forward vs. reverse frequency sweeps in FIGS. 6C-D, respectively. This role of space charge in ultraslow scans is well known (Schwartz et al., J. Am. Soc. Mass Spectrom. 1991, 2, 198).

One motivation for developing multiple resonance ejection methods is to improve the limited resolution of miniature mass spectrometers. Table 3 compares the performance of five resonance methods, including double resonance with dual frequencies at arbitrary values, amplitude modulation, and octopole and hexapole multiple resonance ejection. The hexapole triple resonance at $\beta=2/3$ and amplitude modulation at 350 kHz show the best resolution, whereas the octopole triple resonance and hexapole double resonance exhibit the worst.

TABLE 3

Comparison of resolution obtained with various resonance techniques on a miniature mass spectrometer*

| Method | Frequencies (kHz) | Resolution (m/Δm) m/z 242 | m/z 284 | m/z 355 | m/z 411 | m/z 467 |
|---|---|---|---|---|---|---|
| Hexapole Double Resonance | 333 | 836 | 217 | 240 | 279 | 250 |
| Dual Frequency Double Resonance | 350/648.5 | 162 | 401 | 265 | 388 | 432 |
| Amplitude Modulation | 350/700.5 | 206 | 206 | 433 | 587 | 658 |
| Octopole Triple Resonance | 249.75/749.25 | 196 | 108 | 255 | 380 | 392 |
| Hexapole Triple Resonance | 333/666 | 217 | 360 | 455 | 447 | 449 |

TABLE 3-continued

Comparison of resolution obtained with various resonance techniques on a miniature mass spectrometer*

| Method | Frequencies (kHz) | Resolution (m/Δm) m/z 242 | m/z 284 | m/z 355 | m/z 411 | m/z 467 |
|---|---|---|---|---|---|---|

*All scans were 300 ms in length using an rf amplitude ramp from 464 $V_{0-p}$ to 127 $V_{0-p}$ While it may seem counterintuitive that the nominally symmetric rectilinear trap in the Mini 12 has contributions from hexapole fields, the trap has unsymmetrical apertures in the x and y electrodes which are optimized to cancel octopole and dodecapole field contributions. Hexapole contributions may also have been accidentally introduced, whether by electrode misalignment or different electrode impedances. All methods show much improved resolution at higher mass, which should not be surprising since typically peak width will increase with mass in a typical resonance ejection scan, though there are ways to keep unit resolution up to high masses (m/z 2000).

The data herein show that the resolution of a benchtop ion trap is more than tripled using double resonance ejection at arbitrarily chosen static frequencies and approximately doubled when using a double resonance secular frequency scan. Additional hexapole and octopole resonances are not needed in this method since it only relies upon characteristic ion frequencies rather than characteristic field resonances.

What is claimed is:

1. A system, the system comprising:

a mass spectrometer comprising an ion trap; and a central processing unit (CPU), and storage coupled to the CPU for storing instructions that when executed by the CPU cause the system to:

generate a first frequency signal and a second frequency signal, wherein the first frequency signal is an arbitrary frequency ω and the second frequency signal is a lower trapping sideband Ω rf−ω; or the first frequency signal is an arbitrary frequency 2ω and the second frequency signal is a lower trapping sideband Ωrf−2ω, or the first frequency signal is an arbitrary frequency 3ω and the second frequency signal is a lower trapping sideband Ωrf−3ω; or the first frequency signal is an arbitrary frequency ω that corresponds to a higher order resonance associated with the structure of the ion trap, and the second frequency signal is a lower trapping sideband that corresponds to Ωrf+/−ω;

sum the first and second frequency signals to produce a single summed frequency signal; and apply the single summed frequency signal to the ion trap.

2. The system according to claim 1, wherein the first frequency signal is an alternating current (AC) signal, and the second frequency signal is radio frequency (RF) signal that varies as a function of time.

3. The system according to claim 1, wherein the instructions that when executed by the CPU further cause the system to: apply a third frequency to the ion trap.

4. The system according to claim 1, wherein the ion trap is selected from the group consisting of: a hyperbolic ion trap, a cylindrical ion trap, a linear ion trap, a rectilinear ion trap.

5. The system according to claim 1, wherein the mass spectrometer is a miniature mass spectrometer.

6. The system according to claim 1, further comprising an ionization source.

* * * * *